US005161494A

United States Patent [19]

Brown, Jr.

[11] Patent Number: 5,161,494

[45] Date of Patent: Nov. 10, 1992

[54] ELECTROMAGNETIC VALVE ACTUATOR

[76] Inventor: John N. Brown, Jr., 101 Auborn Ave., Shirley, N.Y. 11967

[21] Appl. No.: 820,792

[22] Filed: Jan. 15, 1992

[51] Int. Cl.[5] ..... F01L 9/04; F01L 1/30

[52] U.S. Cl. ..... 123/90.11; 123/90.15; 123/90.25

[58] Field of Search ..... 123/90.11, 90.15, 90.16, 123/90.24, 90.25, 90.39

[56] References Cited

U.S. PATENT DOCUMENTS

| | | | |
|---|---|---|---|
| 2,997,991 | 8/1961 | Roan | 123/90.16 |
| 4,269,388 | 5/1981 | Seilly et al. | 123/90.11 |
| 4,593,658 | 6/1986 | Moloney | 123/90.11 |
| 4,762,095 | 8/1988 | Mezger et al. | 123/90.11 |
| 4,867,111 | 9/1989 | Schneider et al. | 123/90.11 |
| 4,955,334 | 9/1990 | Kawamura | 123/90.11 |

FOREIGN PATENT DOCUMENTS

| | | | |
|---|---|---|---|
| 673169 | 1/1929 | France | 123/90.11 |
| 600108 | 11/1959 | Italy | 123/90.11 |
| 43280 | 3/1980 | Japan | 123/90.11 |

*Primary Examiner*—E. Rollins Cross
*Assistant Examiner*—Weilun Lo
*Attorney, Agent, or Firm*—Galgano & Belkin

[57] ABSTRACT

An electromagnetic valve actuator for pivoting a rocker arm to open and close a valve of a four-cycle internal combustion engine. The actuator includes a rocker arm with two ends, one end being in contact with the valve. An electromagnet is provided along with means for mounting the electromagnet to selectively attract the end of the rocker arm opposite the valve to open and close the valve. Control means are provided to sequence the electromagnet so that its selective attraction results in favorable timing, lift and duration of the valve opening and closing so that the engine performs optimally throughout its rpm range. The electromagnetic valve actuator can also be configured as a retrofit system which would replace a conventional cam shaft valve lifter configuration with an electromagnetic valve actuator.

16 Claims, 2 Drawing Sheets

ELECTROMAGNETIC VALVE ACTUATOR

BACKGROUND OF THE INVENTION

1. Field of the Invention

The present invention relates to an electromagnetic valve actuator to control the intake and exhaust valves of a four-cycle internal combustion engine. More particularly, it relates to such a device having computer-controlled electromagnetic contacts to automatically and continuously adjust the timing and duration of the valves.

2. The Prior Art

Most four-cycle internal combustion engines utilize a cam shaft or an overhead cam shaft to control the valves. A standard cam shaft includes a power-draining drive gear, valve lifters and heavy return springs, all of which drain power from the engine. An overhead cam shaft, although avoiding the valve lifters, still adds an additional load to the engine.

In addition, these cam shafts are not adjustable. A cam shaft with short duration cam lobe profiles benefit low rpm torque, fuel economy and emissions. A long-duration profile, on the other hand, produces greater horsepower, with correspondingly decreased low rpm power and economy. Engine designers must balance these two extremes for sufficient performance and acceptable emissions under all conditions. Since cam shafts by their construction cannot adjust, the engines cannot produce their optimum power at all times.

Attempts have been made to create electromagnetic valve control systems. For example, U.S. Pat. Nos. 4,942,851, 4,515,343, 4,794,890, 4,312,494, 3,853,102, 4,544,986 and 4,841,923 all disclose electromagnetic valve control systems. However, all of these systems operate directly on the valve stem itself. With such arrangement, the distance between the electromagnets is equal to the valve lift. The greater the distance between electromagnets, the more power needed to move the valve stem and hence, the valve, into either of its two terminal positions.

Furthermore, these systems are not continuously adjustable. In other words, these electromagnetic systems cause the valve to open and close at a predetermined point in the engine's revolutions. The prior art systems do not allow the valve timing to be adjusted continuously as the rpm and load change. The configuration of the prior art devices do not allow for adjustment of the valve lift.

SUMMARY OF THE INVENTION

It is therefore an object of the present invention to eliminate the aforementioned drawbacks of the prior art and to provide an electromagnetic valve actuator which eliminates the power-draining load of a cam shaft.

It is a further object of the present invention to provide such a device which is continuously and automatically adjustable throughout the rpm range.

It is yet another object of the present invention to provide such a device which utilizes the mechanical advantage of a rocker arm.

It is still a further object of the present invention to provide such a device which can be retro-fitted onto internal combustion engines which now utilize cam shafts.

These and other related objects are attained according to the invention by an electromagnetic valve actuator for pivoting a rocker arm to open and close a valve of a four-cycle internal combustion engine. The valve actuator has a rocker arm with two ends, one end of which is in contact with the valve. The valve actuator also includes an electromagnet and means for mounting the electromagnet to selectively attract the end of the rocker arm opposite the valve to open and close the valve. Control means are provided to sequence the electromagnet so that its selective attraction results in favorable timing, lift and duration of the valve opening and closing so that the valve performs optimally throughout its rpm range.

The valve actuator may also include a spring mounted between the engine and the rocker arm which biases the valve in the closed position.

The control means sequence the electromagnets so that the intake valve is open at approximately the top dead center of the piston, and closed at approximately the bottom dead center position of the piston. The exhaust valve is open at approximately the bottom dead center position of the piston, and closed at approximately the top dead center of the position at low rpm. As the rpm increases, the control means keeps the valve open for a greater period of time after the piston reaches bottom dead center. Also, as the rpm increases, the control means opens the exhaust valve increasingly ahead of the bottom dead center position of the piston.

In a preferred embodiment, the electromagnetic valve actuator includes a first electromagnet and a second electromagnet, wherein activation of the first electromagnet pivots the rocker arm to open the valve, and activation of the second electromagnet pivots the rocker arm to close the valve. In such an embodiment, the control means sequences the electromagnets so that they cooperatively attract and repel the end of the rocker arm opposite the valve. The control means can further selectively activate the valve. The control means can further selectively activate the electromagnets so that the valve can be closed in a controlled manner so as to avoid damage to the valve or valve seat.

The means for mounting the electromagnet can include a post which extends through a hole provided in the rocker arm opposite the valve. The post may optionally include at least one electromagnet attached thereon in such a way that the end of the rocker arm opposite the valve comes into contact with said electromagnet when the valve is open. In an alternate embodiment, the post may have two electromagnets mounted thereon. In this way, the end of the rocker arm opposite the valve is in contact with the first electromagnet when the valve is open, and is in contact with the second electromagnet when the second valve is closed.

The electromagnetic valve actuator is provided with a valve cover with a flexible barrier which is formed as a curtain to separate the electromagnets from the end of the rocker arm which is in contact with the valve, and in contact with lubricating oil. The electromagnets and control means are powered by the vehicle's alternator.

The invention can also be configured as a retrofit system for pivoting a rocker arm to open and close a valve of a four-cycle internal combustion engine, which can be retro-fitted to an engine which has a cam shaft and valve lifters. The retrofit electromagnetic valve actuator would include a replacement rocker arm with two ends, one end being in contact with the valve. The valve actuator would include at least one electromagnet. Also provided would be means for mounting the electromagnet to selectively attract the end of the rocker arm opposite the valve to open and close the valve. The valve actuator includes control means to sequence the electromagnet so that its selective attraction results in favorable timing, lift and duration of the valve opening and closing, so that the engine performs optimally throughout its rpm range. The retrofit electromagnetic valve actuator would replace the original rocker arm and valve lifters so as to electronically control the opening and closing of the valve.

BRIEF DESCRIPTION OF THE DRAWINGS

Other objects and features of the present invention will become apparent from the following detailed description considered in connection with the accompanying drawings which discloses two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
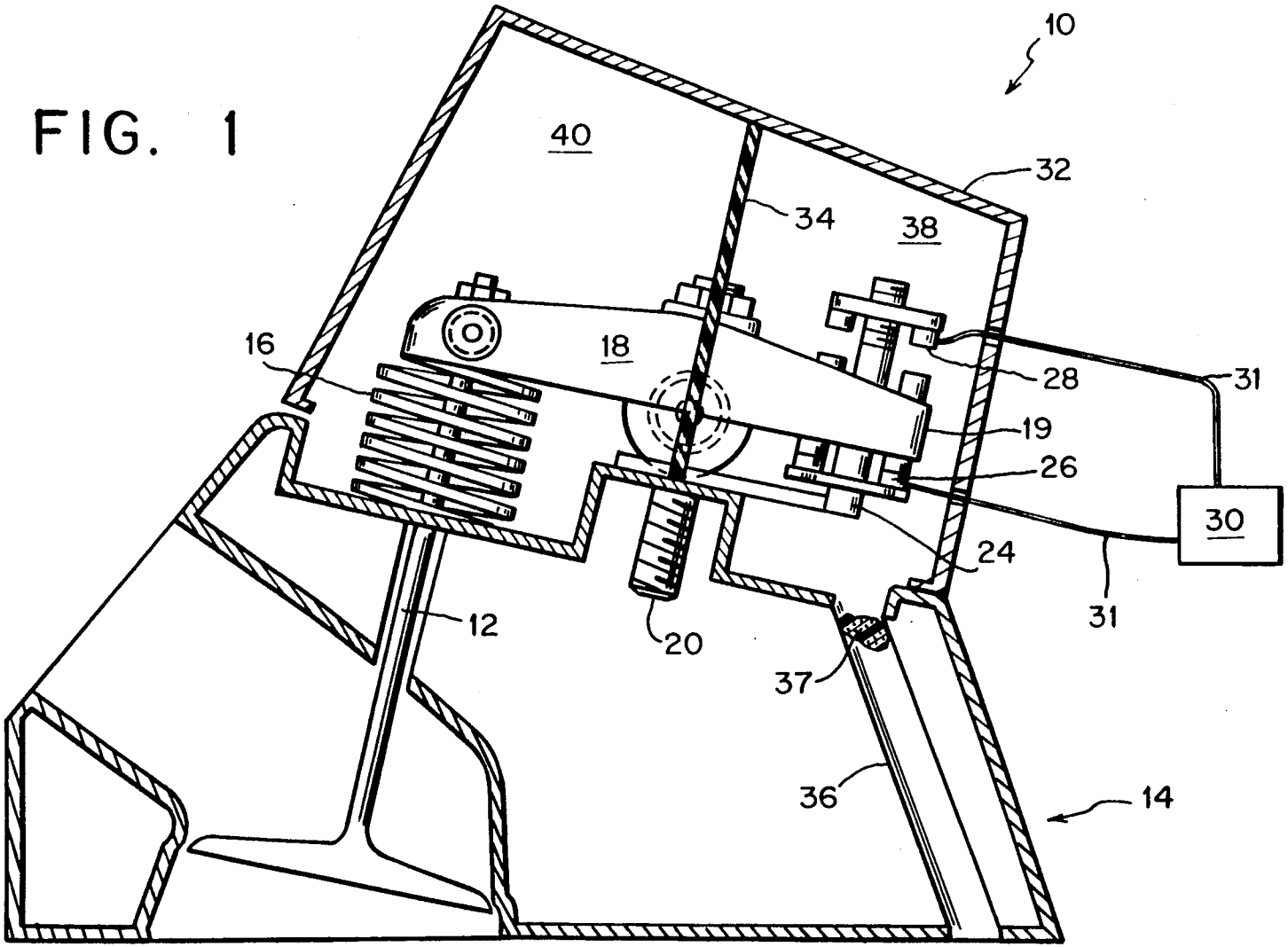
FIG. 1 is a side elevational view of an electromagnetic valve actuator embodying the present invention.
Figure 2:
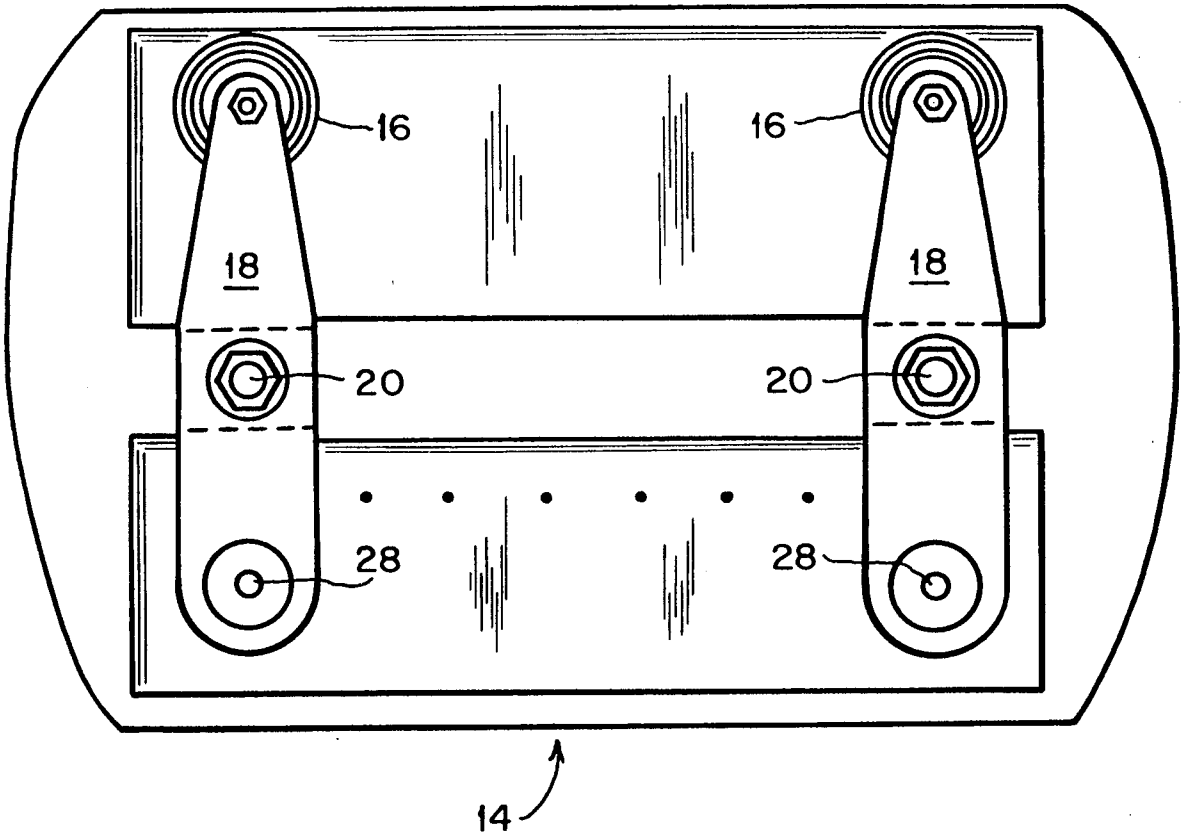
FIG. 2 is a plan view thereof.

Turning now in detail to the drawings, and in particular, FIGS. 1 and 2, there is shown an electromagnetic valve actuator 10 embodying the present invention for actuating a valve 12 of a standard four-cycle internal combustion engine 14. Valve 12 can be an intake valve for introducing air/gasoline mixture into the engine, or an exhaust valve for venting the combustion products. Standard valve 12 is equipped with a lightweight valve return spring 16 and connected to a rocker arm 18 with a needle roller bearing.

Rocker arm 18 fits onto a stud 20 with a needle roller bearing. Rocker arm 18 can also be mounted on a shaft which would be oriented perpendicular to stud 20 and running through all the rocker arms on one side of the engine. Before rocker arm 18 is placed onto stud 20, post 24 is fitted onto stud 20. Post 24 extends in the longitudinal direction of rocker arm 18 away from return spring 16. Post 24 then extends perpendicular to the longitudinal direction of rocker arm 18 and passes through an opening in rocker arm 18 at an end 19 opposite of return spring 16. As rocker arm 18 pivots back and forth to open and close valve 12, end 19 rides up and down along post 24. When valve 12 is seated end 19 of rocker arm 18 would be in its lowermost position, resting against a lower electromagnet 26. When valve 12 is opened, end 19 will be in its raised position, resting against an upper electromagnet 28. Alternatively, the invention can be provided solely with upper electromagnet 28 without lower electromagnet 26, spring 16 being utilized to provide a closing force to valve 12.

Signals from computer 30 alternately energize lower electromagnet 26 and upper electromagnet 28 to cause end 19 of rocker arm 18 to pivot between an open and closed position of valve 12. Computer 30 is connected to the electromagnets by wires 31 which pass through gasketed connectors on valve cover 32. Computer 30 can continuously and automatically adjust the timing and duration of valve 12, opening and closing to optimize engine performance. Electromagnet 28 can be manually adjusted by raising or lowering its position along post 24. This adjustment affects the lift of valve 12. Lower electromagnet 26 can also be adjustable along post 24, but this is not required, as the fully closed position of valve 12 is not changeable. If lower electromagnet 26 is not used, computer 30 would only energize and de-energize upper electromagnet 28.

In a preferred embodiment of the invention, a lightweight valve return spring 16, rocker arm 18, post assembly 24, 26, 28 and a valve cover 32 are provided as a retro-fit upgrade system. More specifically, certain components of the valve/rocker arm assembly would be replaced with new components in order to equip a standard engine with a cam shaft and lifters into an engine utilizing the inventive electromagnetic valve actuator. Lightweight valve return spring 16 would need to be replaced as the electromagnetic contacts 26 and 28 would not provide as much power to end 19 as would a cam shaft and valve lifter.

Rocker arm 18 would need to be replaced by a rocker arm with a hole in end 19. Rocker arm 18 can optimally be connected to valve stem 12 with a needle roller bearing. Post 24, along with at least one electromagnet, would also be included with the retro-fit upgrade. Also, it may be necessary to provide a custom-fabricated valve cover 32 to house the assembly if it is higher than the original rocker arm assembly. Valve cover 32 may include a gasketed center curtain 34 which divides the region under valve cover 32 into two compartments. A right compartment 38 where the electromagnets are located must be separated from a left compartment 40 which contains lubricating oil surrounding valve stem 12. As can be appreciated, oil would detrimentally affect the operation of the electromagnets. Gasketed center curtain 34 would have flexible Teflon® seals around rocker arm 18, for example. Also, a pushrod hole 36 would be plugged, e.g., a piece of foreign matter placed at end 37 of pushrod hole 36. Thus, right compartment 38 will remain dry while left compartment 40 remains lubricated.

Power for the computer and electromagnets would be taken from the automobile's alternator. Ideally, a heavy-duty alternator can be provided to provide the additional power required by the electromagnets. The retro-fit upgrade would be advantageous, since it eliminates the power-draining nonadjustable cam shaft and related components. Since the retrofit upgrade operates electronically rather than mechanically, it would have greater power and fuel economy due to its continually adjusting computer control. A further advantage would be the quieter operation of the electromagnetic valve actuator. Also, the computer control and adjustable electromagnetic contacts 26 and 28 provide greater performance. Computer 30 would be mounted in a readily accessible location, for example, in the dashboard, to allow the driver to adjust the duration of the valve openings.

The embodiment shown in FIG. 1 has valve 12 closed under the biasing force of spring 16 in the rest position. The invention could also be equipped with a second spring which, together with the first spring, would hold the valve open in the rest position. If the rest position holds the valve closed, then only one electromagnet is needed to pivot the rocker arm and open the valve. The single electromagnet is de-energized, and the biasing force of the spring would return the valve to the closed position. If the rest position had the valve open to any degree, then two electromagnets would be required to move the valve to its two terminal positions. Also, if the valve was in its fully opened position in the rest state, then again, only one electromagnet would be necessary to pivot the rocker arm and move the valve into its closed or seated position.

The biasing force of the springs and the computer control can be used together to vibrate or oscillate the valve in sequence with the movement of the piston. One method of oscillating a valve is described in U.S. Pat. No. 4,544,986, for example, the subject matter of which is incorporated herein by reference thereto. It should be understood that many other methods of vibrating or oscillating the valve stem could also be employed with the teachings of the invention. Also, the methods taught in U.S. Pat. No. 4,544,986 would be applied to the rocker arm, not the valve stem itself, as would be well understood by those skilled in the art.

The vibration or oscillations of the valve could be sequenced so that at low rpm, the intake valve opens at the top dead center position of the piston and closes at the bottom dead center position of the piston. The exhaust valve would open at approximately the dead center position of the open, and close at approximately the top dead center position of the piston. An example of a computer control which would be suitable for this purpose is described in U.S. Pat. No. 4,942,851, which is incorporated herein by reference thereto. At higher rpm, the intake valve can be closed at a crankshaft angle of up to approximately 40° past bottom dead center. The exhaust valve can be opened at a crankshaft angle up to approximately 40° ahead of bottom dead center. Also, the valve lift can be controlled by the magnitude of currents supplied to the electromagnets. The valve timing is determined by the crankshaft angle at which the computer determines to close the valve. As can be appreciated, each engine would have a specific valve timing, lift and duration for optimal efficiency throughout the rpm range. The computer 30 could include a ROM chip which would store these optimal values and would instruct the electromagnets to operate based on the engine's rpm, load factor, etc. The voltage to the electromagnets could also be controlled so that when the valve is moved into its closed position, the voltage is reduced so as to gently seat the valve.

Additionally, rocker arm 18 allows for higher ultimate engine speeds than systems operating directly on valve 12. This is due to the mechanical advantage which is achieved by use of the rocker arm. The mechanical advantage is not in torque, but in speed and distance. The distance between the electromagnetic contacts of the prior art systems is equal to the distance of the valve lift. In other words, the electromagnet must drive the valve plate across the distance between the contacts. The use of rocker arm 18 with unequal lever lengths (as is found in virtually all push-rod engines) allows the electromagnet to drive the rocker arm contacts a shorter distance than the valve lift. For example, if valve lift is 0.5000 inches and the rocker arm ratio is 1:1.6 (Chevrolet V-8), then the electromagnet has to drive end 19 0.3125 inches as opposed to the full 0.5000 inches of the other systems. This results in a 37.5% difference. This difference may be even greater for rocker arms with higher ratios.

Although the invention must compensate for the mechanical load of rocker arm 18, the minimized travel distance of end 19 results in greater responsiveness of valve 12 and ultimately better operations at high rpm.

While several embodiments of the present invention have been shown and described, it is to be understood that many changes and modifications may be made thereunto without departing from the spirit and scope of the invention as defined in the appended claims.

What is claimed is:

1. An electromagnetic valve actuator for pivoting a rocker arm to open and close a valve of a four-cycle internal combustion engine comprising:

a rocker arm with a center portion and two ends, one end being in contact with the valve, said rocker arm being pivotably supported in its center portion;

a first electromagnet and a second electromagnet;

means for mounting said electromagnets to selectively attract the end of said rocker arm opposite the valve to open and close the valve, wherein activation of said first electromagnet pivots said rocker arm to open the valve and activation of said second electromagnet pivots said rocker arm to close the valve; and control means to sequence said electromagnets so that their alternating selective attraction results in favorable timing, lift and duration of the valve opening and closing so that the engine performs optimally throughout its rpm range.

2. The electromagnetic valve actuator as claimed in claim 1, additionally including a spring mounted between the engine and said rocker arm, which biases the valve in the closed position.

3. The electromagnetic valve actuator as claimed in claim 2, wherein said control means sequences said electromagnet so that the intake valve is open at approximately the top dead center position of the piston and closed at approximately the bottom dead center position of the piston, and the exhaust valve is open at approximately the bottom dead center position of the piston and closed at approximately the top dead center position of the piston at low rpm.

4. The electromagnetic valve actuator as claimed in claim 3, wherein as the rpm increases, said control means keeps the intake valve open for a greater period of time after the piston reaches bottom dead center.

5. The electromagnetic valve actuator as claimed in claim 4, wherein as the rpm increases, said control means opens the exhaust valve increasingly ahead of the bottom dead center position of the piston.

6. The electromagnetic valve actuator as claimed in claim 1, additionally including a valve cover including a gasketed curtain, which divides said valve cover into two compartments, a dry first compartment which contains the electromagnets, and a wet second compartment which is in contact with the valve and engine lubricating oil.

7. The electromagnetic valve actuator as claimed in claim 1, wherein said control means sequences said electromagnets so that they cooperatively attract and repel the end of said rocker arm opposite the valve.

8. The electromagnetic valve actuator as claimed in claim 7, wherein said control means selectively activates said electromagnets so that the valve can be closed in a controlled manner so as to avoid damaging the valve or the valve seat.

9. The electromagnetic valve actuator as claimed in claim 1, wherein said means for mounting said electromagnet is a post disposed adjacent to said end of said rocker arm opposite the valve.

10. The electromagnetic valve actuator as claimed in claim 9, wherein said post includes at least one of said electromagnets attached thereon in such a way that the end of the rocker arm opposite the valve comes into contact with said one of said electromagnets when the valve is open.

11. The electromagnetic valve actuator as claimed in claim 9, wherein said post has said electromagnets mounted thereon, so that the end of said rocker arm opposite the valve is in contact with said first electromagnet when the valve is open, and is in contact with said second electromagnet when the valve is in the closed position.

12. The electromagnetic valve actuator as claimed in claim 11, additionally including a valve cover with a flexible barrier which is formed as a curtain to separate said electromagnets from the end of said rocker arm which is in contact with the valve, and in contact with lubricating oil.

13. The electromagnetic valve actuator as claimed in claim 12, wherein the electromagnets and control means are powered by the vehicle's alternator.

14. A retrofit electromagnetic valve actuator for pivoting a rocker arm to open and close a valve of a four-cycle internal combustion engine, which can be retrofitted to an engine which has a cam shaft and valve lifters, comprising:

a replacement rocker arm with two ends, one end being in contact with the valve;

a first electromagnet and a second electromagnet;

means for mounting said electromagnets to selectively attract the end of said rocker arm opposite the valve to open and close the valve, said first electromagnet pivoting the rocker arm to open the valve and said second electromagnet pivoting the rocker arm to close the valve; and control means to sequence said electromagnets so that their alternating selective attraction results in favorable timing, lift and duration of the valve opening and closing so that the engine performs optimally throughout its rpm range, the retrofit electromagnetic valve actuator replacing the original rocker arm and valve lifters so as to electronically control opening and closing of the valve.

15. An electromagnetic valve actuator for pivoting a rocker arm to open and close a valve of a four-cycle internal combustion engine comprising:

rocker arm with two ends, one end being in contact with the valve;

an electromagnet;

means for mounting said electromagnet to selectively attract the end of said rocker arm opposite the valve to open and close the valve, wherein said means for mounting said electromagnet is a post which extends through a hole provided in the end of said rocker arm opposite the valve; and control means to sequence said electromagnet so that its selective attraction results in favorable timing, lift and duration of the valve opening and closing so that the engine performs optimally throughout its rpm range.

16. The electromagnetic valve actuator as claimed in claim 15, wherein said post includes at least one electromagnet attached thereon in such a way that the end of the rocker arm opposite the valve comes into contact with said electromagnet when the valve is open.

* * * * *